US005186542A

United States Patent [19]

Seabold

[11] Patent Number: 5,186,542

[45] Date of Patent: Feb. 16, 1993

[54] TAPE HANDLE FOR A CONTAINER AND METHOD FOR CONSTRUCTION THEREOF

[75] Inventor: Thomas W. Seabold, St. Paul, Minn.

[73] Assignee: Minnesota Mining and Manufacturing Company, St. Paul, Minn.

[21] Appl. No.: 830,547

[22] Filed: Jan. 31, 1992

Related U.S. Application Data

[63] Continuation of Ser. No. 596,863, Oct. 12, 1990, abandoned.

[51] Int. Cl.[5] ..... B65D 33/06

[52] U.S. Cl. ..... 383/25; 383/14; 383/17; 294/27.1; 229/117.26

[58] Field of Search ..... 383/6, 7, 8, 13, 14, 383/16, 17, 20, 21, 22, 24, 25, 28, 29, 30; 229/117.09, 117.11, 117.19, 117.23, 117.26, 68 C, DIG. 6; 294/27.1

[56] References Cited

U.S. PATENT DOCUMENTS

| | | | |
|---|---|---|---|
| 1,524,399 | 1/1925 | Krueger | 229/68 C X |
| 1,909,368 | 5/1933 | Lloyd . | |
| 2,236,681 | 4/1941 | Goldschmidt | 229/68 C |
| 2,522,049 | 9/1950 | Lang | 229/36 |
| 2,760,716 | 8/1956 | Weiner | 229/52 |
| 3,031,359 | 4/1962 | Blank et al. | 154/53.5 |
| 3,053,434 | 9/1962 | Atwood | 383/20 |
| 3,206,104 | 9/1965 | Harrison . | |
| 3,208,492 | 9/1965 | Braithwaite | 383/20 X |
| 3,409,209 | 11/1968 | Finke | 229/54 |
| 3,490,681 | 1/1970 | Niemeyer | 383/25 X |
| 3,514,033 | 5/1970 | Goodwin | 383/8 X |
| 3,557,516 | 1/1971 | Brandt | 53/14 |
| 3,774,836 | 11/1973 | Nunn | 229/52 |
| 3,801,012 | 4/1974 | Thelen | 229/52 |
| 3,808,957 | 5/1974 | Hosoya et al. | 93/36.7 |
| 3,834,970 | 9/1974 | Mitsuoka et al. | 156/489 |
| 3,894,300 | 7/1975 | Shively | 383/25 X |
| 3,913,786 | 10/1975 | Kartasuk | 221/70 |
| 4,050,216 | 9/1977 | Stenberg | 53/14 |
| 4,119,268 | 10/1978 | Segura | 383/25 X |
| 4,238,256 | 12/1980 | Faust et al. | 156/65 |

(List continued on next page.)

FOREIGN PATENT DOCUMENTS

| | | | |
|---|---|---|---|
| 0186020 | 7/1985 | European Pat. Off. . | |
| 0310831 | 9/1988 | European Pat. Off. . | |
| 3122339 | of 0000 | Fed. Rep. of Germany . | |
| 2048485 | 4/1971 | Fed. Rep. of Germany . | |
| 2125421 | 5/1971 | Fed. Rep. of Germany . | |
| 2157072 | 6/1973 | Fed. Rep. of Germany | 493/226 |
| 3205340 | 8/1983 | Fed. Rep. of Germany | 383/6 |
| 3209220 | 9/1983 | Fed. Rep. of Germany . | |
| 3634238 | 4/1988 | Fed. Rep. of Germany | 383/17 |
| 8802094 | 5/1988 | Fed. Rep. of Germany . | |
| 3440958 | 6/1990 | Fed. Rep. of Germany . | |
| 2053590 | 4/1971 | France | 383/25 |
| 7911551 | 12/1980 | France . | |
| 86138010/22 | 11/1980 | Japan . | |
| WO91/04918 | 4/1991 | PCT Int'l Appl. . | |
| 1265704 | 8/1969 | United Kingdom . | |
| 2078500 | 5/1981 | United Kingdom . | |
| 2156316A | 3/1984 | United Kingdom . | |

OTHER PUBLICATIONS

Brochure entitled, "Scotch® T-12 Tape Handle Dispenser" Type 165; 2 pages.

Brochure entitled "Tesa Handylift," BDF tesa Ltd.; 3 pages, undated.

Brochure entitled "Tape Handle Dispenser," undated, 2 pages, Midway Machine Company.

Photographs, No.s 1-10.

*Primary Examiner*—Allan N. Shoap

*Assistant Examiner*—Jes F. Pascua

*Attorney, Agent, or Firm*—Gary L. Griswold; Walter N. Kirn; Peter L. Olson

[57] ABSTRACT

A handle for use with a container such as a flexible bag structure. The handle includes first and second handle members that reinforce each other as the handle is grasped to manipulate the bag structure.

23 Claims, 8 Drawing Sheets

U.S. PATENT DOCUMENTS

| | | | |
|---|---|---|---|
| 4,269,314 | 5/1981 | Barrash | 206/428 |
| 4,269,322 | 5/1981 | Larson | 220/94 |
| 4,286,714 | 9/1981 | Zdarsky et al. | 206/526 |
| 4,294,058 | 10/1981 | Rensner | 53/413 |
| 4,296,861 | 10/1981 | Barrash | 206/428 |
| 4,339,070 | 7/1982 | Davies | 229/52 |
| 4,411,383 | 10/1983 | Morris | 229/52 |
| 4,418,864 | 12/1983 | Nielsen | 229/52 |
| 4,498,620 | 2/1985 | Dickert et al. | 229/52 |
| 4,583,681 | 4/1986 | Neese | 229/52 |
| 4,650,537 | 3/1987 | Pereoman | 156/518 |
| 4,679,823 | 7/1987 | Nagy | 281/15 |
| 4,700,528 | 10/1987 | Bernard | 53/390 |
| 4,716,707 | 1/1988 | Gambetti | 53/134 |
| 4,735,601 | 4/1988 | Cinotti | 493/88 |
| 4,745,727 | 5/1988 | Cinotti | 53/134 |
| 4,758,301 | 7/1988 | Inoko et al. | 156/361 |
| 4,781,474 | 11/1988 | Sengewald | 383/24 X |
| 4,816,014 | 3/1989 | Bratton et al. | 493/88 |
| 4,830,895 | 5/1989 | Bernard | 428/34.2 |
| 4,905,888 | 3/1990 | Suoss et al. | 383/14 X |
| 5,026,173 | 6/1991 | Jensen | 493/226 X |
| 5,071,260 | 12/1991 | Poppe et al. | 383/30 X |
| 5,080,281 | 1/1992 | Seabold | 229/117.26 X |

TAPE HANDLE FOR A CONTAINER AND METHOD FOR CONSTRUCTION THEREOF

This is a continuation of application Ser. No. 07/596,863 filed Oct. 12, 1990, now abandoned.

TECHNICAL FIELD

The present invention relates to handles for articles, and more particularly to handles for flexible bag structures.

BACKGROUND ART

Flexible bag structures have been employed for products with multiple discrete components that may be dispensed in a flowable state, such as dog food, cement, charcoal, or powdered substances. Such flexible bag structures are difficult to grasp, lift or carry since neither the bag or its contents provide any structural support. More recently, these difficulties have become of increased importance as the size and weight of bags and their contents have tended to increase in the marketplace. Such bags are currently being marketed with weights (including contents) of 40–50 pounds (88–110 kg) or more.

Handles have been provided in the past for manipulating containers, and specifically for flexible bag structures. Preferably, a handle for a bag structure is lightweight, inexpensive (since it is likely that the bag and the handle will be discarded after dispensing the contents), easily and quickly applied, unobtrusive prior to use, and securely attached to the bag during manipulation of the bag and its contents.

Flexible bag structures have been provided in the past with die cut or molded polymeric handles. Such handles are relatively expensive and are not efficient in distributing stress or weight. Further, it is difficult to attach the handle to the bag structure without penetrating the walls of the bag, thereby exposing the contents of the bag to the environment. Die cut or molded handles are relatively thick and inflexible and render the bag difficult to store or handle efficiently.

Tape handles may be devised for flexible bag structures that are less expensive, less obtrusive and easier to apply than the die cut or molded handles discussed above. However, such tape handles would be deficient in several respects. For instance, a tape handle may be devised that includes a segment of pressure sensitive adhesive tape and a segment of deadening material applied to cover or mask an intermediate portion of the pressure sensitive adhesive side of the tape, with end portions of the pressure sensitive adhesive side of the tape segment remaining exposed for application to a bag. The tape handle may be applied to a bag to form a loop protruding from the bag with the length of the loop equal to the length of the deadening material. The remaining portions of the pressure sensitive adhesive side of the tape segment are applied to and adhere to the bag.

However, when such a tape handle is grasped within the loop and the bag and its contents lifted, the adhesion of the tape to the bag is stressed at least partially in a peel mode. A pressure sensitive adhesive tape typically exhibits that weakest bond strength to a surface when stressed in a peel mode, as compared to a shear mode. Such conventional tape handles thus have an tendency to detach from the bag at an undesirably low level of force. This limits the container weight for which a particular handle may be used.

Thus, it is desirable to provide a tape handle that is inexpensive, unobtrusive, easily applied and securely adhered to a container such as a flexible bag structure.

SUMMARY OF INVENTION

According to the present invention, there is provided a handle for use with a bag including: (a) a first flexible handle member having a first side and a second side and opposing end portions; (b) a second flexible handle member, having a first side and a second side and opposing end portions; (c) means for adhering a portion of said first handle member to the bag; (d) means for adhering a portion of said first handle member to a portion of said second side of said second handle member to form a loop; (e) means for adhering to the bag spaced portions of said second side of said second handle member on opposite sides of said portion attached to said first handle member; and (f) whereby when adhered to the bag, the handle may be manually grasped within said loop to manipulate the bag.

The present invention further provides a method for forming the handle, including the steps of: (a) providing a bag; (b) providing a first flexible handle member having a first side and a second side and opposing end portions; (c) providing a second flexible handle member, having a first side and a second side and opposing end portions; (d) adhering said first handle member to said second side of said second handle member and to the bag to form a loop; and (e) adhering to the bag spaced portions of said second side of said second handle member on opposite sides of said portion attached to said first handle member, whereby the handle may be manually grasped within said loop to manipulate the bag.

Another method for forming the handle of the present invention includes the steps of: (a) providing a first flexible web having opposing first and second major surfaces; (b) providing a second flexible web having opposing first and second major surfaces; (c) folding the first flexible web about a medial longitudinal axis to form a tube with said second major surface presented outwardly; (d) adhering the first web to the second web about a longitudinal medial strip; and (e) severing a transverse segment of the first and second webs to form the handle.

Such method may further include the step of: (f) adhering unattached portions of the second major surface of the second web and a portion of the first web to exterior of the bag to attach the handle to the bag.

Means may also be provided as part of the handle of this invention to releasably secure the loop of the handle generally flush with the bag prior to use so that the handle is unobtrusive until needed.

BRIEF DESCRIPTION OF DRAWINGS

The present invention will be further described with reference to the accompanying drawings wherein like reference numerals refer to like parts in the several views, and wherein.

DETAILED DESCRIPTION

Figure 1:
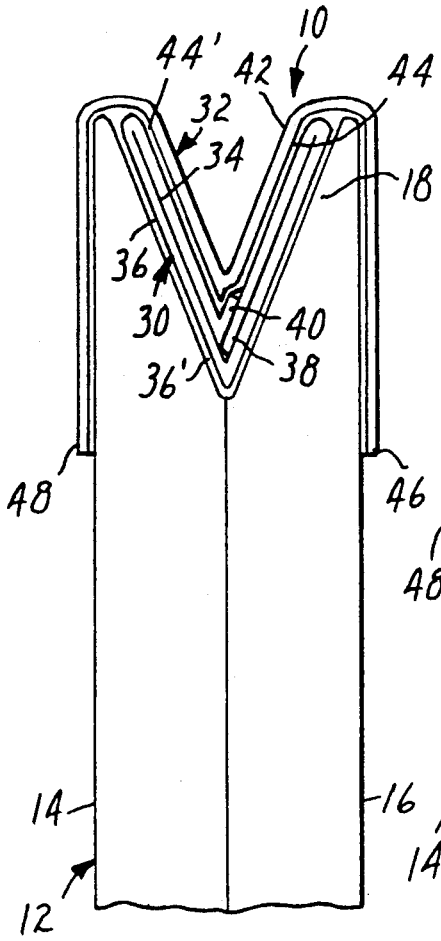
FIG. 1 is a partial cross sectional view of a bag having a handle according to the present invention attached thereto in a folded condition.
Figure 2:
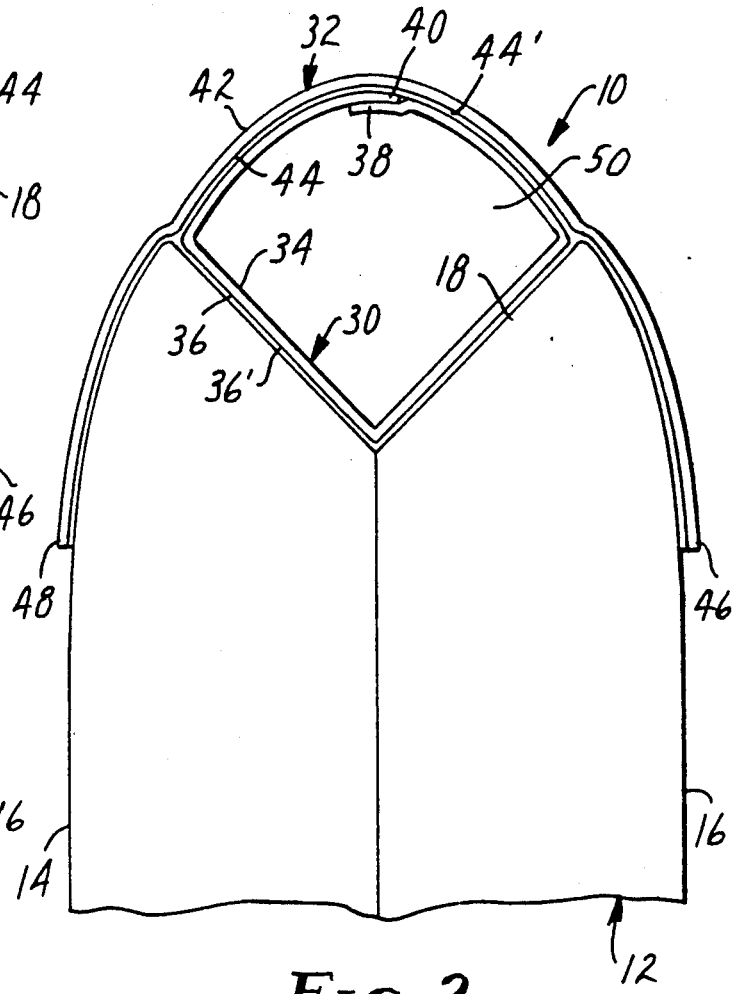
FIG. 2 is a partial cross sectional view of the bag and handle of FIG. 1 with the handle in an extended condition.
Figure 3:
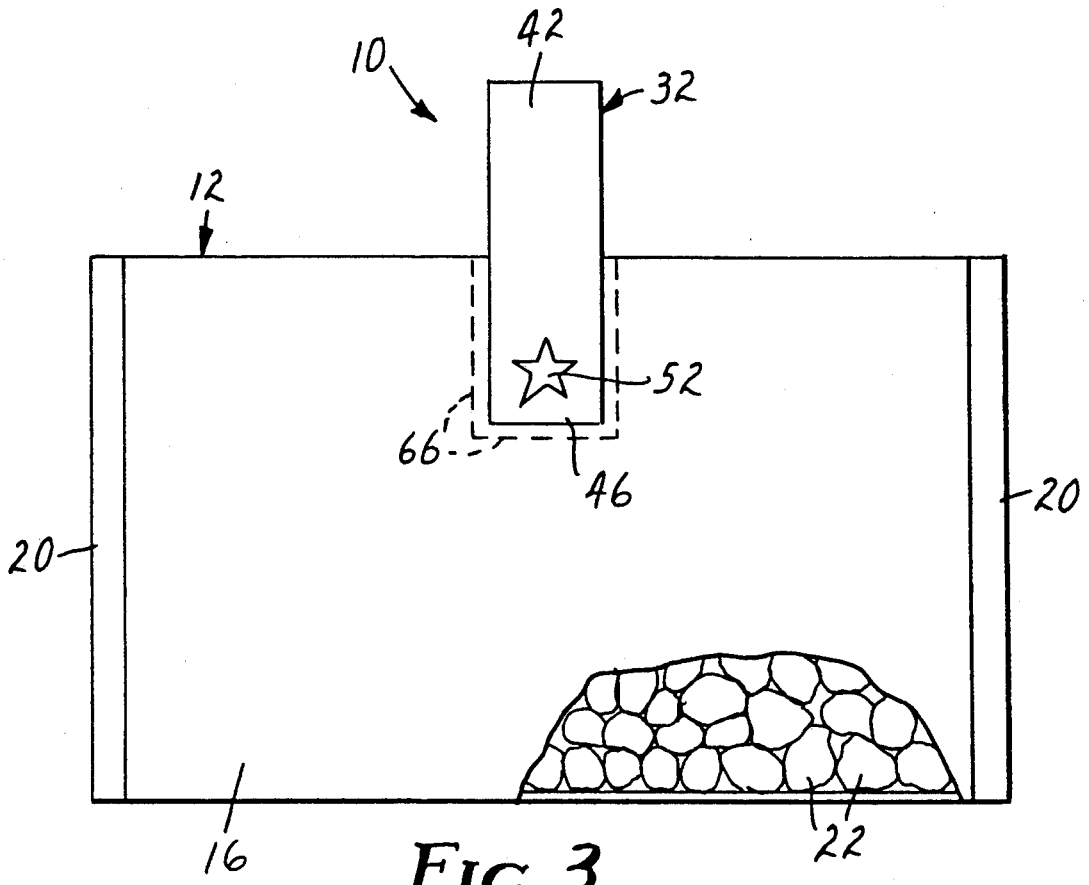
FIG. 3 is a side view, partially broke away, of the handle and bag of FIG. 2.

Referring now to FIGS. 1, 2, and 3 of the drawings, there is shown a tape handle according to the present invention generally designated by the reference numeral 10. The tape handle of the present invention is for use with containers so that the handle may be easily grasped and the container manipulated (e.g. lifted or carried). Although the handle of the present invention may be employed with any suitable container, such as rigid Regular Slotted Cartons (RSC), preferably, the handle is applied to a container in the form of a flexible bag structure 12, such as is shown in FIGS. 1, 2 and 3. Such bag structures include opposing major sides 14 and 16 and preferably include opposing pleated side walls 18 (only one of which is shown in FIGS. 1 and 2). Most preferably, the flexible bag structure is tubular and includes openings at each end that are closed by closures 20 after the bag is filled. Such closures are known in the art and will not be discussed in greater detail further herein.

The pleated side walls 18 enable the bags to be stored in a flat or folded arrangement, such as shown in FIG. 1, prior to receipt of the intended contents 22 (shown in FIG. 3) of the bag. In the illustrated embodiment, the contents of the bag are products with multiple discrete components that may be dispensed in a flowable state, such as dog food, cement, charcoal, or powdered substances. However, it will be appreciated that the handle of the present invention may be employed with a bag containing any substance.

Figure 2A:
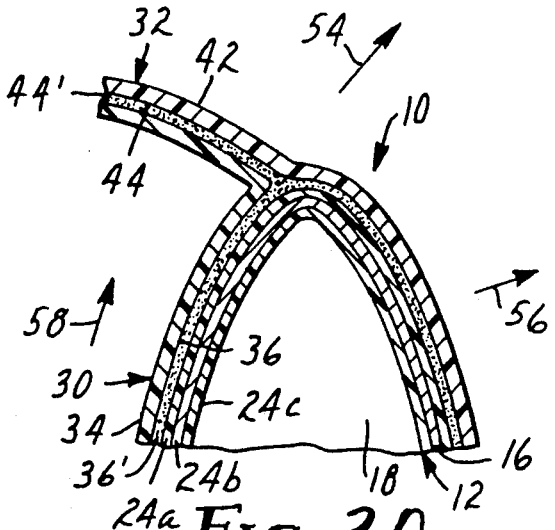
FIG. 2A is a magnified partial cross sectional view of the handle and bag of FIG. 2.

Bag structures may be constructed of multi-walled material. That is, the bags are constructed from multiple layers 24*a*, 24*b*, 24*c*, as shown in FIG. 2A, such as from a paper or cardstock material. One or more of the layers may be constructed of a polymeric material or the like, designed to act as a moisture barrier to protect the contents of the bag. One example of a commercially available flexible tubular bag structure is the package for the dog food marketed under the trademark "Kibbles and Bits" by The Quaker Oats Company of Chicago, Ill.

Generally, the tape handle 10 comprises a first handle member 30 and a second handle member 32. The first handle member 30 includes first side 34 and a second side 36 and opposing end portions 38 and 40. Likewise, the second handle member 32 includes a first side 42 and a second side 44 and opposing end portions 46 and 48.

As shown also in FIG. 2, the handle 10 is formed by adhering a portion of the second side 36 of the first handle member 30 to the side wall 18 of the bag 12. Another portion of the second side 36 of the first handle member 30 is adhered to an intermediate, and preferably a medial, portion of the second side 44 of the second handle member 32 to form a loop 50. Loop 50 is adapted for manually grasping of the first and second handle members for manipulation a container when the handle is attached thereto. Spaced portions of the second side 44 of the second handle member 32 are adhered to the opposing major sides 14 and 16 of the bag 10.

In regard to the illustrated form of container, the handle is applied as shown, preferably over the center of gravity of the bag when filled. Generally, this point will be the midpoint of the bag. However, it will be understood that the handle of the present invention may be applied to any edge or even to a major side of a container, as is found to be convenient. For instance, the bag may be formed with pleated end wall and the handle applied to the pleated end wall for manipulation of the bag in an upright orientation.

Although any suitable adhesive may be utilized to adhere the first and second handle members 30, 32 to each other and to the bag as shown, such as heat activated or moisture activated adhesives, in the preferred embodiment of the invention, the first and second handle members 30 and 32 are provided in the form of pressure sensitive adhesive tape segments, wherein the respective second sides 36 and 44 of the first and second handle members include a layer of pressure sensitive adhesive (36', 44') and the opposite respective first sides 34 and 38 are non-adhesive back sides. Any tape may be employed that is found satisfactory for a particular container surface.

Figure 7:
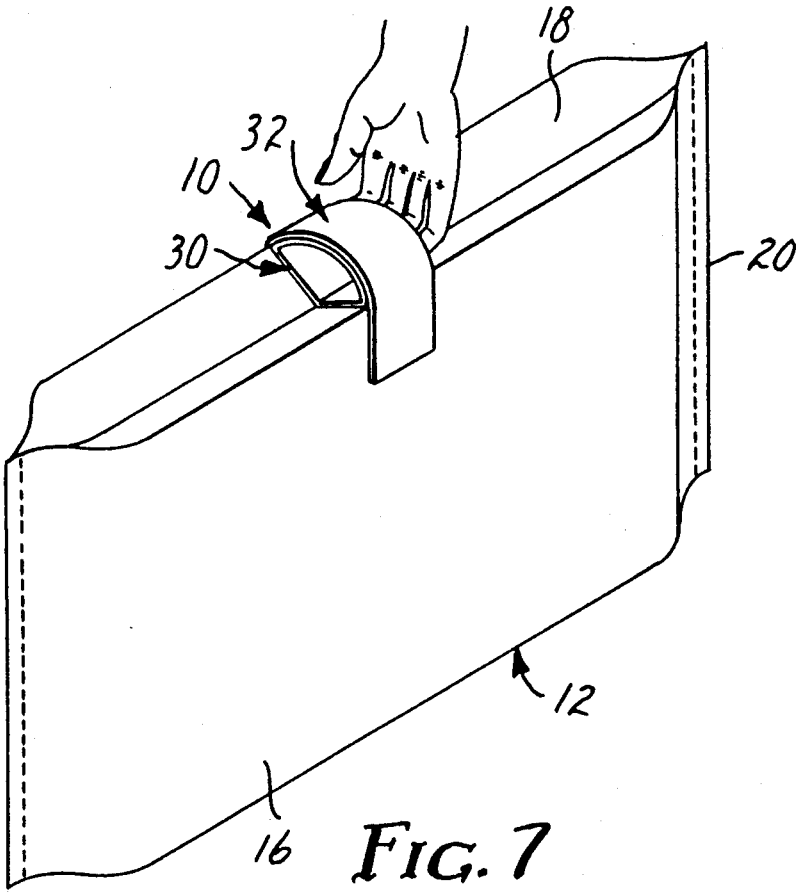
FIG. 7 is an isometric view of the handle and bag of FIG. 3, with a hand inserted into the loop formed by the handle for engagement therewith.

It is one of the advantages of the present invention, compared to conventional die cut or molded handles, that the handle 10 is relatively thin and flexible and may be applied to the wall material used to construct the bag, prior to formation of the bag, or to the formed bag 12 prior to receipt of the contents of the bag and in such a state, may be retracted in a folded position into the pleated, folded side wall 18 of the bag, as shown in FIG. 1. The handle 10 is thus unobtrusive and may be quickly and conveniently applied to the empty bag, which may then be stored and handled with the handle in the unobtrusive position shown. The handle 10 may be retained in the retracted position even after the bag has been filled and then, when desired, manually grasped and extended to the position shown in FIGS. 2, 3 and 7. In the extended position, the handle may be easily and quickly manually grasped through loop 50 for manipulation of the bag and its contents.

The first and second handle members 30 and 32 may be constructed of any color, or either may be translucent or transparent (for the purposes of this invention, both terms shall be jointly be referred to as "light transmissive"). In the preferred embodiment of the invention, the second handle member is light transmissive and the first handle member is colored or opaque so as to be visually perceptible externally of the handle. The first or the second handle members may each include indicia 52, such as advertising logos or instructions for use of the handle.

While being manipulated, the handle of the present invention provides improved adherence to the bag compared to conventional tape handles such as previously described. This is shown in FIG. 2A, such that a force applied to the handle in direction 54 is transmitted to the end portion 46 (shown in FIGS. 1 and 2) of the second handle member 32 adhered to the major side 16 of the bag, generally in a "peel" mode approximately in direction 56. However, a portion of the force is also transmitted to the portion of the first handle member 30 adhered to the pleated side wall 18 adjacent side 16 along direction 58 generally in a "shear" mode, which generally provides a stronger bond. The first handle member thus reinforces the second handle member during use.

Figure 2B:
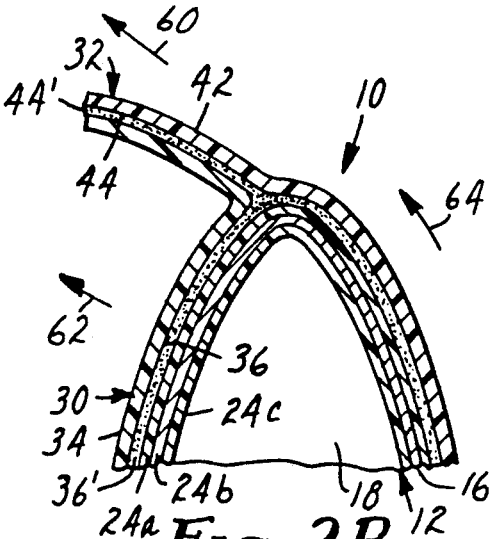
FIG. 2B is another magnified partial cross sectional view of the handle and bag of FIG. 2.

Further, if the handle of the present invention is pulled in direction 60, as shown in FIG. 2B, it will be appreciated that the force will be applied to the first handle member 30 adhered to the pleated side wall 18 adjacent side 16 along direction 62, or generally in a peel mode, and the second handle member will reinforce the first handle member with a portion of the force transmitted along direction 64, generally in a shear mode. Thus, if the handle is pulled in a lateral direction, one side of the handle will be stressed as described with respect to FIG. 2A and the other side of the handle will be oppositely stressed as described with respect to FIG. 2B, with both sides being self reinforced. Thus, the handle of the present invention ensures that no matter how the handle is grasped or manipulated, the handle will not be adhered to the bag solely in a peel mode and the strength of adherence and security of the handle will be increased substantially.

To further enhance the strength of the handle when used with multi-walled flexible bags, the bags may be constructed with the portions of the layers adjacent and underlying the locations where the spaced portions 46, 48 of the second handle member are adhered to the outermost layer of the bag, are reciprocally adhered together (as at 66 in FIG. 3).

Figure 5:
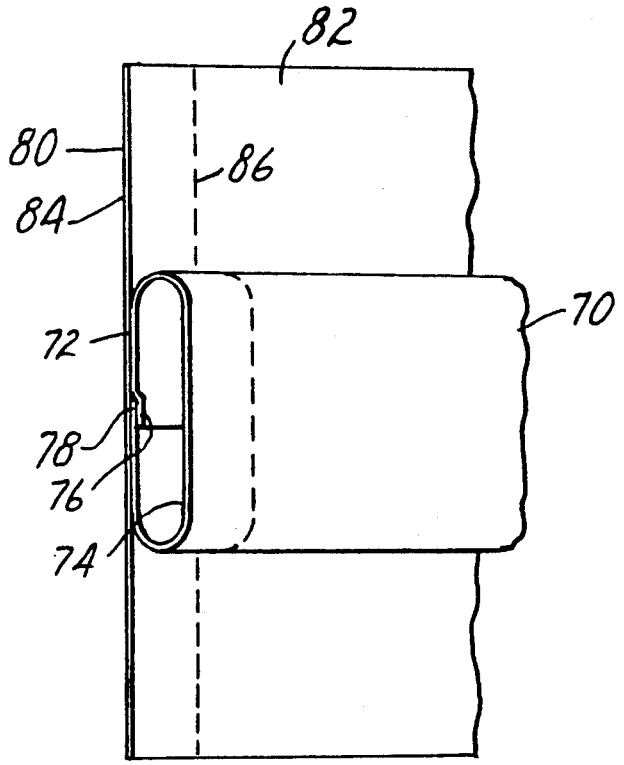
FIG. 5 is an isometric view of two webs adhered to each other according to the method of the present invention, with a transverse segment of the adhered webs severed to form the handle of the present invention.
Figure 4A:
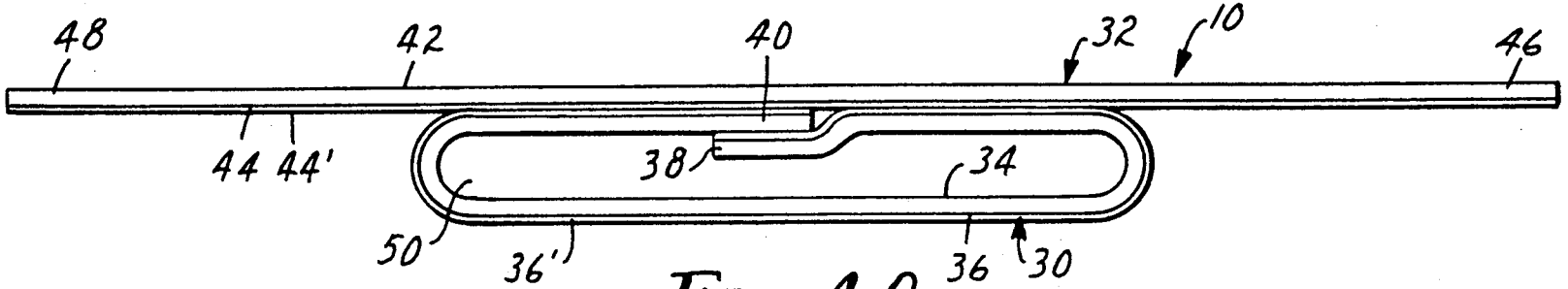
FIG. 4A is a side view of a preferred embodiment of the handle of this invention.

As is shown in FIGS. 1, 2 and 4A, the preferred embodiment of the invention provides that the opposite end portions 38 and 40 of the first handle member 30 are overlapped adjacent an intermediate, and preferably a medial, portion of the second handle member 32 to form loop 50. One method for constructing the embodiment of FIG. 4A is illustrated in FIG. 5. A first web 70 having an adhesive side 72 and a back side 74 is formed into a continuous tube with pressure sensitive adhesive side 72 presented outwardly and laterally spaced side edges 76 as 78 overlapped in a longitudinal direction. A second web 80 having a pressure sensitive adhesive side 82 and a non-adhesive back side (not shown) is aligned with the first web 70. The pressure sensitive adhesive sides 72 and 82 of the first and second webs are reciprocally adhered at an intermediate, and preferably medial, line on the second web 80. A portion of the structure thus constructed is transversely severed, such as at the line 86, to form a handle 10 having a first handle member 30 and second handle member 32 of a desired width. A plurality of such handles may thus be sequentially formed in a similar fashion.

Figure 4B:
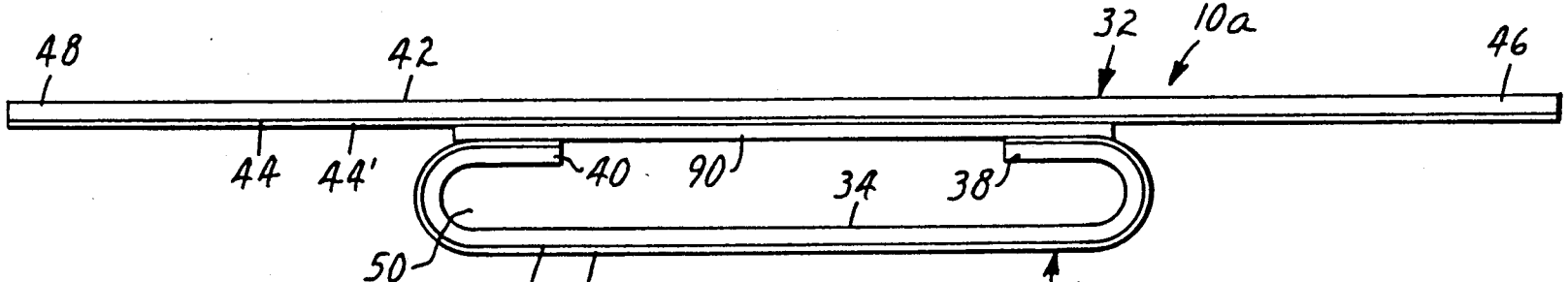
FIG. 4B is a side view of an alternate embodiment of the handle of the present invention.

As shown in FIG. 4B, an alternative embodiment **10*a* of the handle of the present invention may be constructed without overlapping the end portions of the first handle member. As illustrated, a segment of masking or deadening material 90 may be interposed between the respective second sides 36 and 44 of the first and second handle members. If the first and second handle members are provided in the form of segments of pressure sensitive adhesive tape, then the segment of masking material may be non-adhesive. As previously described in regard to the first and second tape segments, the deadening material 90** may in a similar manner be light transmissive or opaque and may include indicia (not shown).

Figure 4C:
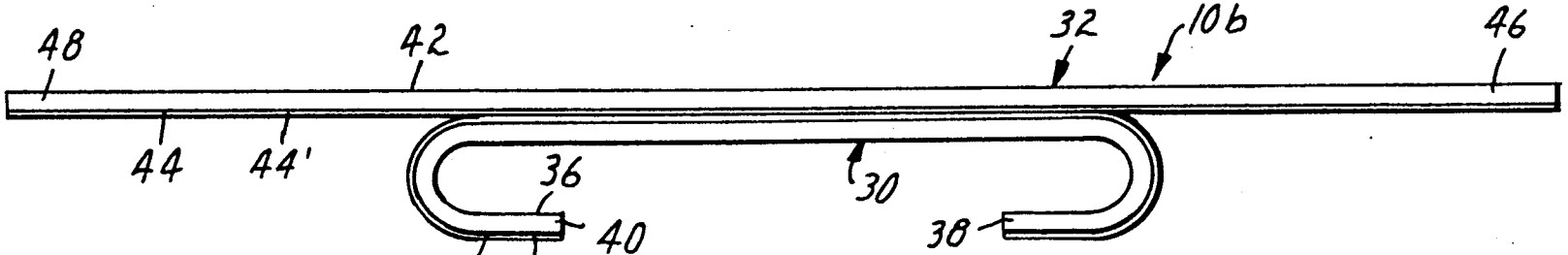
FIG. 4C is a side view of yet another alternate embodiment of the handle of the present invention.

FIG. 4C illustrates yet another alternate embodiment **10*b* of the present invention wherein first side 34 of first handle member 30 includes a layer of adhesive 34'. An intermediate, and preferably medial, portion of the first side 34 of the first handle member 30 is adhered by layer 34' to an intermediate, and preferably medial, portion of the second side 44 of the second handle member 32. Spaced end portions 38,40 of the first side 34 of the first handle member on opposite sides of the portion adhered to the second handle member are adhered by layer 34' to pleated side wall 18 of the bag, and end portions 46, 48 of the second side of the second handle member 32 opposite the portion adhered to the first handle member are adhered to the major sides 14, 16 of the bag to secure the handle 10*b* to the bag 12 as previously described. Although not illustrated, it is within the spirit and scope of the present invention for the opposed end portions 38 and 40 of the first handle member 30 to be overlapped and adhered to the side wall 18, in a similar but inverted manner to that shown in FIG. 4A**.

All of the above embodiments of this invention provide the advantages previously discussed herein when compared to conventional handles for flexible bag structures.

Figure 6A:
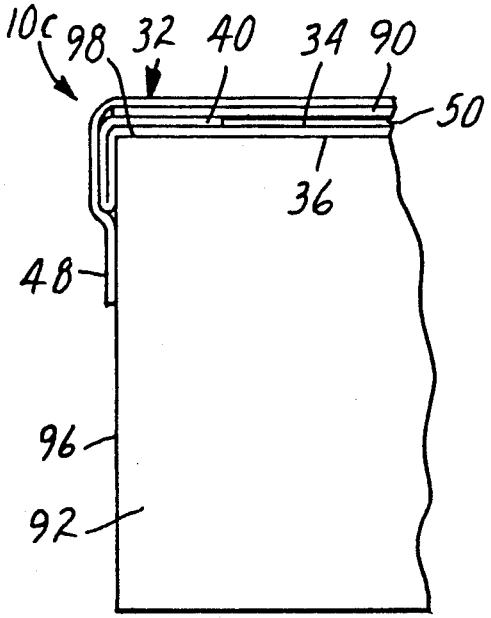
FIG. 6A is a partial side view of one embodiment the tape handle of the present invention applied to a rigid regular slotted carton.
Figure 6B:
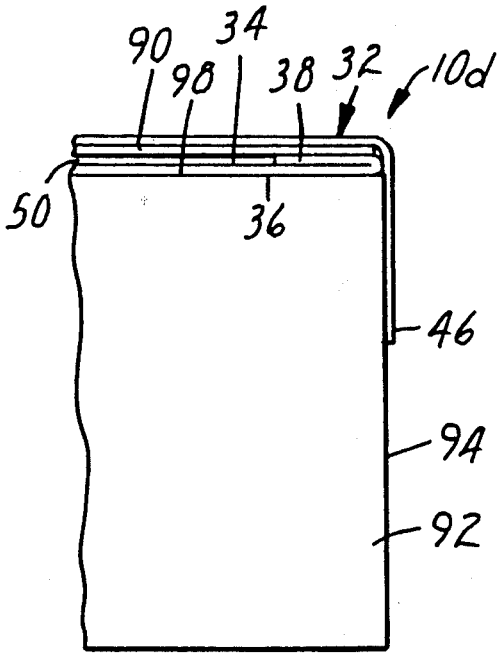
FIG. 6B is a partial side view of another embodiment the tape handle of the present invention applied to a rigid regular slotted carton.

In FIG. 6A, an embodiment **10*c* of the handle of this invention is shown wherein first handle member 30 extends over the edges of top 98 of rigid, rectangular Regular Slotted Carton (RSC) carton 92 (only one end of which is shown) and is adhered to sides 94 (not shown) and 96 and to the second side of the second handle member 32 prior to use. In this embodiment, the portion of the loop 50 in contact with ends 94 (not shown) and 96 of carton 92 act to retain abutting cover flaps (not shown in FIG. 6A) on top side 98** generally flush when the handle is grasped and the carton lifted. However, such an arrangement requires that the loop 50 be formed with a longer length of material than might otherwise be necessary, thus increasing the expense of the handle, or the size of the loop available for manual engagement is reduced. FIG. 6B shows another embodiment 10*d* of the handle wherein loop 50 terminates without extending over the edges of top 98 of the carton 92 (only one end of which is shown) onto sides 94 and 96 (not shown). In this embodiment, the handle is less expensive than the embodiment shown in FIG. 6A, but the abutting cover flaps (not shown in FIG. 6B) of the carton have a tendency to separate and extend upwardly when the carton is lifted.

In some embodiments of the invention, it is desirable for the loop 50 of the handle to be releasably secured to the bag so as to remain generally flush with the bag prior to use. The loop may then be grasped and detached from the bag for use as herein described. For instance, the apparatus for forming or filling the bag may contact the pleated side wall of the bag in a manner that snags a side edge of the handle and thus interferes with the operation of the apparatus and potentially damaging the handle.

Figure 8:
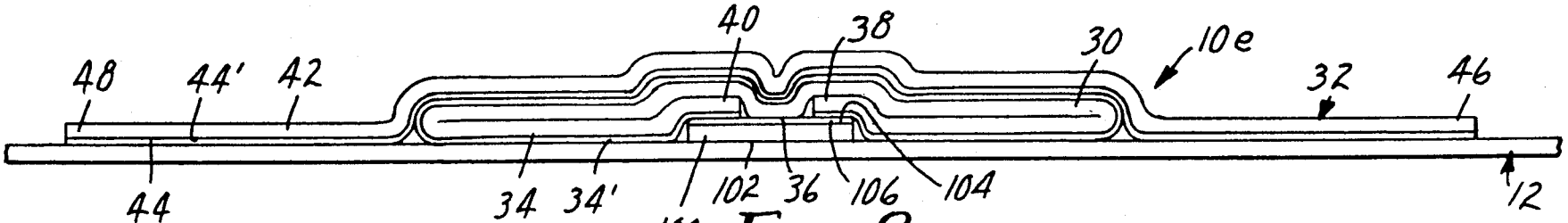
FIG. 8 is a side view of an embodiment of this invention including means for releasably securing the loop generally flush to the bag prior to use.

In FIG. 8, handle 10*e* is shown in which opposing ends 38 and 40 of the first handle member 30 are spaced apart. Tab 100 includes back side 102 and side 104 coated with a layer of adhesive 106, preferably pressure sensitive adhesive. The adhesive side 106 of tab 100 is adhered to the first side 34 of the first handle member 30 across the spaced ends 38, 40. A portion of the adhesive side 106 of the tab 100 is exposed for contact with a portion of the second side 36 of the first handle member 30. Thus the loop 50 is secured so as to be generally flush with the bag prior to use. Upon detachment of the first handle member 30 from the tab 100, a small portion of the adhesive layer 106 of the tab is exposed, but will not significantly interfere with the operation of the handle.

Figure 9:
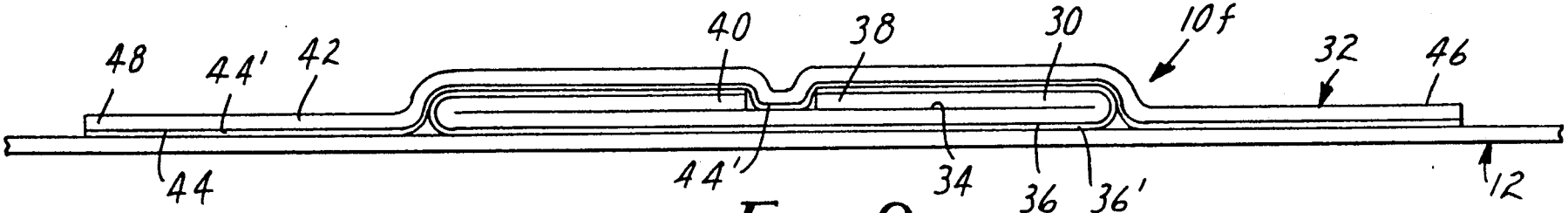
FIG. 9 is a side view of an embodiment of this invention including means for releasably securing the loop generally flush to the bag prior to use.

In FIG. 9, handle 10*f* is shown wherein the opposing ends 38 and 40 of the first handle member 30 are spaced apart adjacent so that a portion of second surface 44 of the second handle member 32 extends through. In this embodiment, the adhesive side 44' of the second handle member adheres to a portion of the first side 34 of the first handle member, thus eliminating the need for a separate tab. As in the embodiment 10*e* in FIG. 8, a small portion of the adhesive surface 44' of the second handle member 32 will be exposed after separation, but will not significantly interfere with the operation of the handle.

Figure 10:
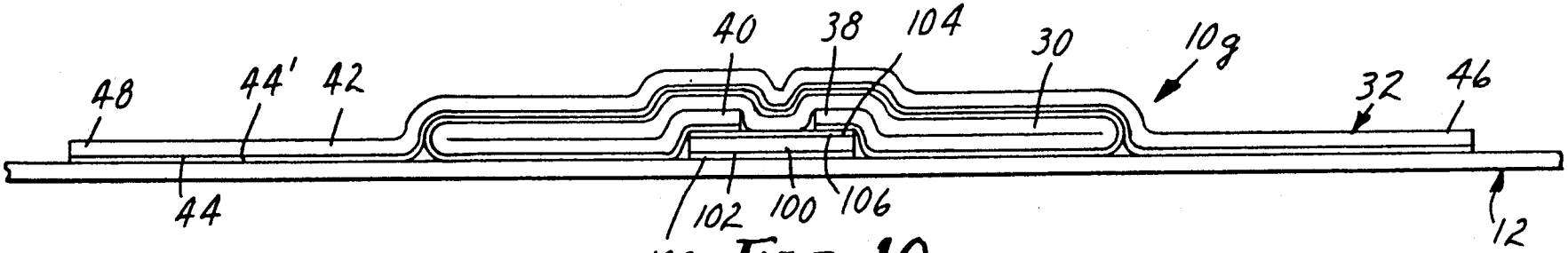
FIG. 10 is a side view of an embodiment of this invention including means for releasably securing the loop generally flush to the bag prior to use.

FIG. 10 shows an embodiment 10*g* of the handle that is similar to the embodiment of the handle shown in FIG. 8, except that tab 100 includes a layer of adhesive 108, preferably pressure sensitive adhesive, on back side 102. The tab 100 is adhered by adhesive layers 106 and 108 to both the bag 12 and the first handle member 30 so that the loop is releasably secured to the bag prior to use.

Figure 11:
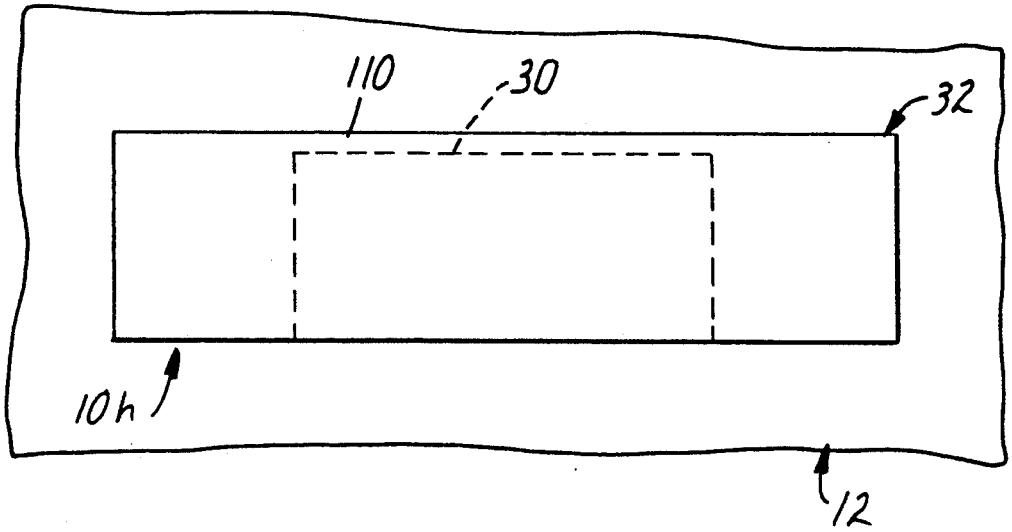
FIG. 11 is a top view of yet another embodiment of the invention including means for releasably securing the loop generally flush to the bag prior to use.

FIG. 11 shows an embodiment 10*h* of this invention wherein the first handle member 30 has a width that is less than the width of the second handle member 32. A portion 110 of the adhesive surface 44' (not shown in FIG. 11) of the second handle member 32 that is the leading edge of the handle that first encounters or contacts the bag handling apparatus. The exposed portion 110 of the adhesive surface 44' of the second handle member provides sufficient adherence to the bag 12 to prevent premature detachment of the handle from the bag, yet permits easy and convenient use of the handle when desired.

Figure 12:
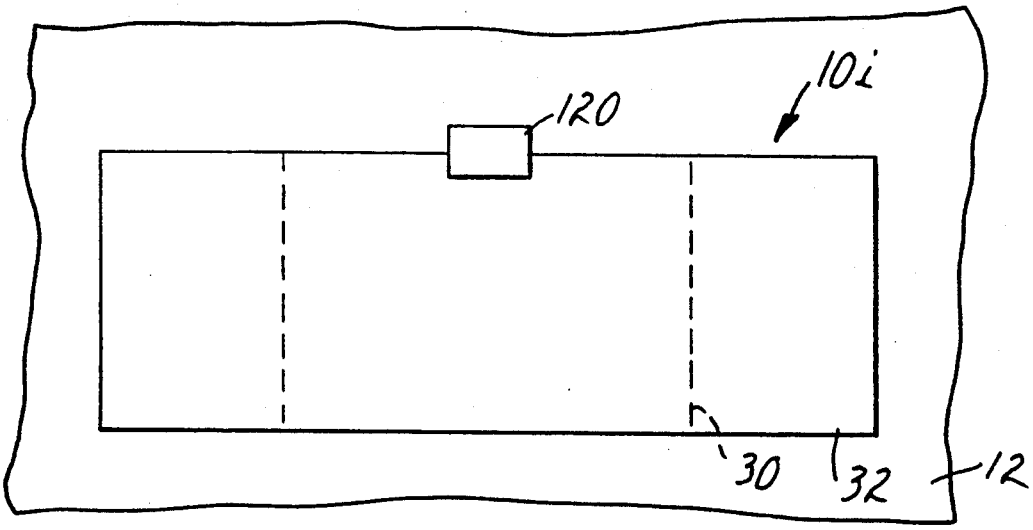
FIG. 12 is a top view of another embodiment of the invention including means for releasably securing the loop generally flush to the bag prior to use.
Figure 13:
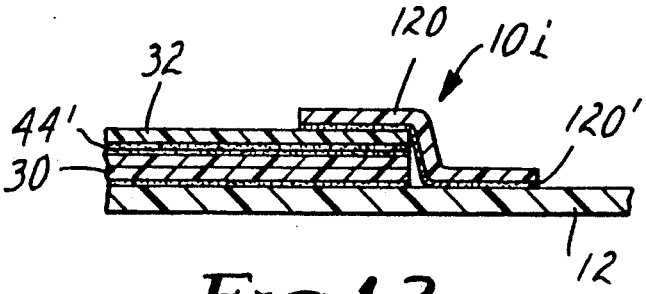
FIG. 13 is a partial cross sectional view of the handle of FIG. 12.

FIGS. 12 and 13 show an embodiment 10*i* of the invention in which tab 120 is adhered to the exterior of the handle (e.g. the first side 42 of the second handle member 32) and to the bag 12 adjacent the handle such as by layer of adhesive 120'. The strength of adherence of the tab to the handle and to the bag provides sufficient adherence to the bag to prevent premature detachment of the handle from the bag, yet permits easy and convenient use of the handle when desired.

Figure 14:
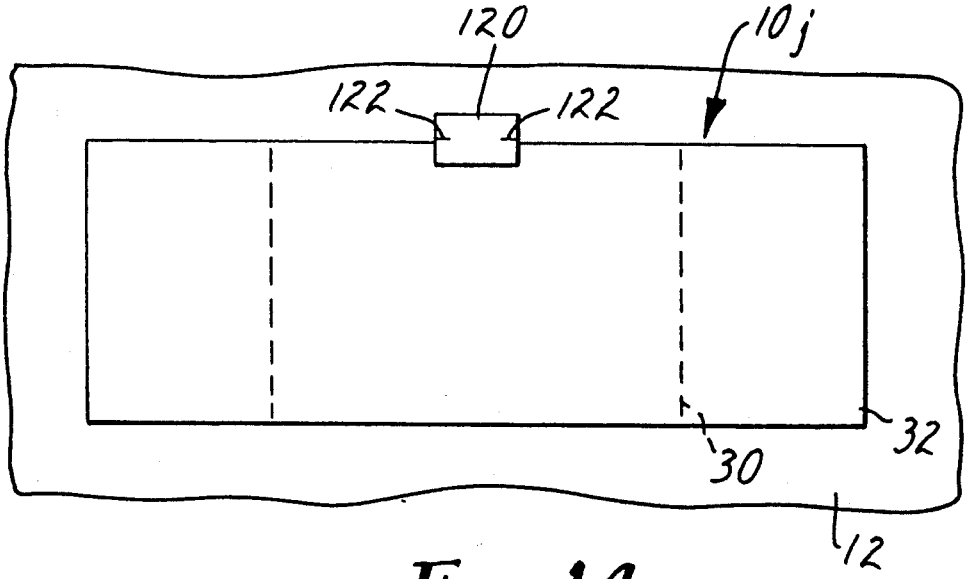
FIG. 14 is a top view of yet another embodiment of the invention including means for releasably securing the loop generally flush to the bag prior to use.

FIG. 14 shows yet another embodiment 10*j* of the tab 120 shown in FIGS. 12 and 13. Tab 120 includes tear lines 122 that facilitates detachment of the handle from the bag. The tear line 122 may be defined by a score line or perforated line extending across the tab parallel to the edge of the handle (neither of which is shown). In the illustrated embodiment the tear line 122 is defined by one or more slits in the tab extending inwardly and parallel to the edge of the handle. The slits propagate a tear in the tab as the handle is being lifted to divide the tab 120 and thereby detach the loop from the bag.

Figure 15:
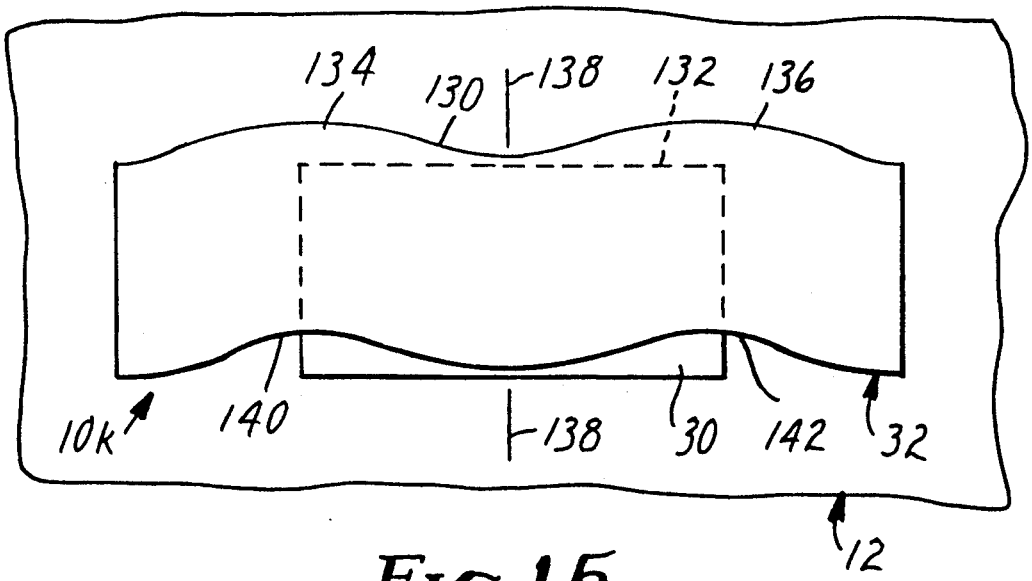
FIG. 15 is a top view of another embodiment of the invention including means for releasably securing the loop generally flush to the bag prior to use.

FIG. 15 illustrates yet another embodiment 10*k* of this invention in which the second tape segment 32 includes at least one undulating longitudinal edge 130 with at least a portion of the edge 130 projecting beyond the edge 132 of the first tape segment, in a similar fashion to the embodiment 10*h* in FIG. 11. In this manner, a portion of the pressure sensitive adhesive surface 44' of the second tape segment is exposed and provided to releasably secure the loop 50 generally flush with the bag prior to use. Preferably, as shown in FIG. 15, a pair of protuberances or convex portions 134 and 136 are spaced on either side of a medial line 138 which is aligned with the pleated fold of the bag side wall 18 when the handle is attached thereto. As shown, the second tape segment 32 further includes opposing undulating edge 140 having concave portions 140, 142 similar in size and shape and aligned with convex portions 134 and 136, so that that the entire second tape segment is constructed in an undulating manner. This construction also enables a plurality of second tape segments to be separated from a continuous web of tape material, similar to the manner shown in FIG. 5, with the concave portions of one tape segment conforming to the convex portions of the next sequential second tape segment to be separated. The exposed portions of the adhesive surface 44' of the second handle member beneath the convex portions 134 and 136 provide sufficient adherence to the bag 12 to prevent premature detachment of the handle from the bag, yet permit easy and convenient use of the handle when desired. A strip of deadening material 90 is interposed between the first and second handle members 30 and 32 to cover the exposed adhesive of first handle member 30.

Figure 16:
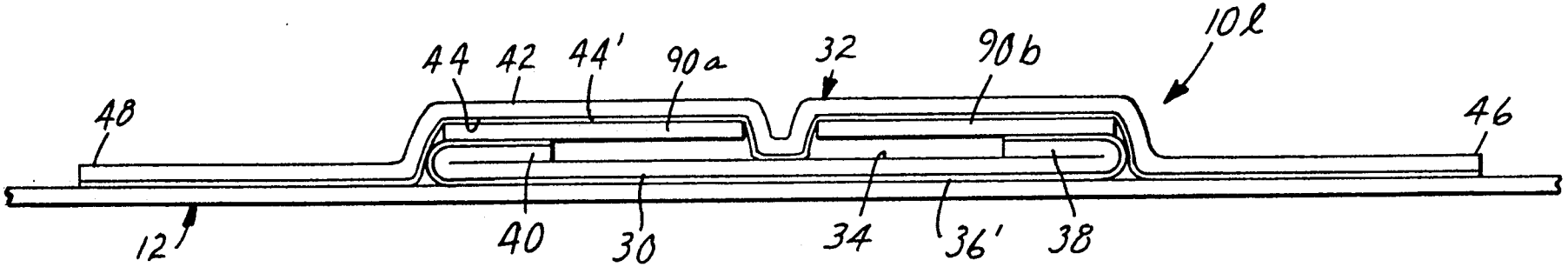
FIG. 16 is a side view of another embodiment of the invention including means for releasably securing the loop flush to the bag prior to use.

In FIG. 16, another embodiment 101 of the invention is shown similar to the embodiment 10*a* shown in FIG. 4B. However, instead of the single strip of deadening material 90 shown in FIG. 4B, a pair of spaced strips of deadening material 90*a*, 90*b* are provided, with strip 90*a* adhered to the adhesive side 36' of the second side 36 of first handle member 30 adjacent end portion 40, and the adhesive layer 44' of second side 44 of second handle member 32. Likewise, strip 90*b* is adhered to the adhesive side 36' of the second side 36 of first handle member 30 adjacent end portion 38, and the adhesive layer 44' of second side 44 of second handle member 32. The gap between strips 90*a* and 90*b* enables a portion of the adhesive layer 44' of the second handle member 32 to contact the first side 34 of the first handle member and releasably secure the loop generally flush with the bag prior to use, in a manner similar to the embodiments shown in FIGS. 8–10. As in the embodiment 10*d* in FIG. 8, a small portion of the adhesive surface 44' of the second handle member 32 will be exposed after separation, but will not significantly interfere with the operation of the handle.

In any of the above embodiments, the means for securing the loop generally flush with the bag may be employed on either or both edges of the handles to ensure that the handle is unobtrusive prior to use.

The present invention has now been described with reference to several embodiments thereof. It will be apparent to those skilled in the art that many changes can be made in the embodiments described without departing from the scope of the present invention. Thus, the scope of the present invention should not be limited to the structures described in this application, but only by structures described by the language of the claims and the equivalents of those structures.

What is claimed is:

1. In combination:

(a) a container having an exterior;

(b) a first segment of tape having a back side and a pressure sensitive adhesive free of adhesive side and opposing end portions, with a portion of said pressure sensitive adhesive side of said first tape segment adhered to said exterior of said container;

(c) a second segment of tape having a back side free of adhesive and a pressure sensitive adhesive side and opposing end portions with a portion of said pressure sensitive adhesive side adhered to said pressure sensitive adhesive side of said first tape segment to form a loop and spaced portions of said pressure sensitive adhesive side of said second tape segment adhered to the container on opposite sides of said portion adhered to said pressure sensitive adhesive side of said first tape segment;

(d) whereby the handle may be manually grasped within said loop to manipulate the container.

2. The combination of claim 1, wherein the container is a flexible bag structure.

3. The combination of claim 2, wherein said bag is a multiple layer flexible tubular bag structure having a pair of opposing major sides and a pleated side wall and wherein said first tape segment is adhered to said pleated side wall and said pressure sensitive adhesive side of said second tape segment is adhered at opposite ends to said opposing major sides of said bag.

4. The combination of claim 3, wherein said multiple layers of said bag are reciprocally adhered adjacent the location where said second tape segment is adhered to the outermost layer of said bag, to increase the strength of said handle.

5. The combination of claim 3, wherein said end portions of said first tape segment are adhered to said pleated side wall of said bag to form said loop.

6. The combination of claim 5, wherein said end portions of said first tape segment are spaced apart and further including a tab having a back side and a pressure sensitive adhesive side adhered to said first side of said first tape segment adjacent said end portions and to said second side of said first tape segment intermediate said end portions of said first tape segment to releasably secure said loop generally flush with said bag prior to use.

7. The combination of claim 6, wherein said back side of said tab is adhered to the bag.

8. The combination of claim 3, wherein opposed ends of said pressure sensitive adhesive side of said first tape segment are adhered to said pressure sensitive adhesive side of said second tape segment to form said loop.

9. The combination of claim 8, wherein said end portions of said second tape segment are spaced apart and wherein said pressure sensitive adhesive side of said second tape segment is adhered to said first side of said first tape segment intermediate said spaced end portions to releasably secure said loop generally flush to said bag prior to use.

10. The combination of claim 8, wherein said opposed end portions of said first tape segment are overlapped adjacent said second tape segment.

11. The combination of claim 8, wherein a strip of deadening material is interposed between said pressure sensitive adhesive sides of said first and said second tape segments.

12. The combination of claim 1, wherein said second tape segment is light transmissive, and wherein said first tape segment is visually perceptible through said second tape segment.

13. The combination of claim 12, wherein said first tape segment includes indicia visually perceptible through said second tape segment.

14. The combination of claim 3, wherein a portion of said pressure sensitive adhesive side of said second tape segment is releasably adhered to said pleated side wall of said bag and to portions of said major sides of said bag to retain said handle generally flush with said bag prior to use.

15. The combination of claim 1, further including means for releasably securing said loop generally flush with the bag when the handle is adhered to bag prior to use.

16. The combination of claim 15, further including a tab adhered to said second tape segment and to said bag to secure said loop generally flush with the bag prior to use.

17. The combination of claim 16, wherein said tab further includes means for dividing said tab to facilitate detachment of said loop from said bag.

18. The combination of claim 17, wherein said dividing means includes a slit formed in said tab adjacent said second tape segment.

19. The combination of claim 17, wherein said dividing means includes a perforated line formed in said tab adjacent said second tape segment.

20. The combination of claim 17, wherein said dividing means includes a scored line formed in said tab adjacent said second tape segment.

21. The combination of claim 15, wherein said means for releasably securing includes a portion of second tape segment projecting beyond an edge of said first tape segment to expose a portion of said layer of adhesive on said second tape segment so that said pressure sensitive adhesive releasably secures said handle to said bag to retain said loop flush with said bag prior to use.

22. The combination of claim 15, wherein said means for releasably securing includes said second tape segment having an undulating side edge, with at least a portion of said undulating side edge projecting beyond a side edge of said first tape segment to expose a portion of said layer of pressure sensitive adhesive on said second tape segment so that said layer of pressure sensitive adhesive releasably secures said handle to said bag to retain said loop flush with said bag prior to use.

23. The combination of claim 22, wherein said second tape segment includes a second undulating side edge.

* * * * *